US009976559B2

(12) United States Patent
Shih et al.

(10) Patent No.: US 9,976,559 B2
(45) Date of Patent: May 22, 2018

(54) ELECTRONIC DEVICE AND FAN-RETAINING STRUCTURE THEREOF

(71) Applicants: LITE-ON ELECTRONICS (GUANGZHOU) LIMITED, Guangzhou (CN); LITE-ON TECHNOLOGY CORPORATION, Taipei (TW)

(72) Inventors: Yi-An Shih, Taipei (TW); Ming-Yuan Tsai, New Taipei (TW)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 360 days.

(21) Appl. No.: 14/734,163

(22) Filed: Jun. 9, 2015

(65) Prior Publication Data

US 2016/0222983 A1 Aug. 4, 2016

(30) Foreign Application Priority Data

Feb. 2, 2015 (CN) ..... 2015 2 0074256 U

(51) Int. Cl.
*F04D 29/60* (2006.01)
*F04D 19/00* (2006.01)

(52) U.S. Cl.
CPC ..... *F04D 19/002* (2013.01); *F04D 29/601* (2013.01)

(58) Field of Classification Search
CPC . F04D 19/002; F04D 29/601; H05K 7/20172; H05K 7/20727; H05K 7/20136; H05K 7/20145; H05K 7/20154; H05K 7/20163; G06F 1/20; G06F 1/203
USPC ..... 415/213.1; 361/694, 695, 679.47, 361/679.48, 679.49, 679.51, 690
See application file for complete search history.

(56) References Cited

U.S. PATENT DOCUMENTS 4,598,894 A * 7/1986 Johannes ..... F04D 29/601 248/222.11
2008/0286100 A1* 11/2008 Hu ..... F04D 19/007 415/214.1
2013/0108435 A1* 5/2013 Zhou ..... G06F 1/20 415/213.1
2013/0142644 A1* 6/2013 Zeng ..... H05K 7/20172 415/220

(Continued)

*Primary Examiner* — Aaron R Eastman
(74) *Attorney, Agent, or Firm* — Li & Cai Intellectual Property (USA) Office

(57) ABSTRACT

An electronic device includes a housing and a fan. The housing has a fan-retaining structure including a base, two side walls and at least one elastic clamping unit. The two side walls are disposed on the base and respectively have a guiding slot and an elastic clamping unit. The two guiding slots and the base corporately define a receiving space. The elastic clamping unit has a top-blocking portion formed on one end thereof. The fan is selectively mounted in the receiving space along a longitudinal direction. As the fan is disposing into the receiving space, the top-blocking portion is propped up by the fan, and the elastic clamping unit is elastically curved outward. After the fan is disposed in the receiving space, the top-blocking portions and the base corporately clamp the fan, and the movement of the fan is restricted in the longitudinal direction and in a radial direction.

24 Claims, 13 Drawing Sheets

(56) References Cited

U.S. PATENT DOCUMENTS

| | | | | |
|---|---|---|---|---|
| 2013/0309064 | A1* | 11/2013 | Liu | F04D 19/002 415/119 |
| 2015/0351280 | A1* | 12/2015 | Gonzalez Inda | H05K 7/20172 361/695 |
| 2017/0042060 | A1* | 2/2017 | Chen | H05K 7/20172 |

* cited by examiner

ELECTRONIC DEVICE AND FAN-RETAINING STRUCTURE THEREOF

BACKGROUND OF THE INVENTION

1. Field of the Invention

The present invention is related to an electronic device and fan-retaining structure thereof. In particular, the present invention relates to a fan which can be quickly dismounted from a fan-retaining structure and an electronic device having fan-retaining structure.

2. Description of Related Art

Most electronic products have requirements of heat-dissipation. In generally, if using the inner space of electronic products is allowed, cooling fans are most popularly used for directly dissipating heat. Most of the fans are directly fixed by screws on the housing or other parts of the electronic product. However, the way of using screws to fix the fan in the electronic product causes much inconvenience to a user or manufacturer in practical usage. For example, when the user wants to replace the fan, the screws firstly must be removed one by one and the fan is taken out. After the fan is installed, the screws must be screwed again one by one. Such a manner not only is time-consuming, but also requires much work. Further, screws are easily lost. Similarly, for production workers assembling the electric product, it is time-consuming and requires much work assembling the fans. The assembling time and manufacturing cost of the electronic products are increased.

To resolve the above issues, the inventor researched and proposes the following design solutions to address the above shortcomings. Therefore, it is desirable to propose an electronic device and fan-retaining structure thereof to overcome the above-mentioned problems.

SUMMARY OF THE INVENTION

It is one objective of this invention to provide an electronic device and a fan-retaining structure thereof, so as to solve the problem of a fan of a conventional electronic device that cannot be quickly dismounted from a fan-retaining structure.

In order to achieve the above objective, the present disclosure provides a fan-retaining structure, which includes a base, two side walls and at least one elastic clamping unit. The two side walls are disposed on the base and being opposite to each other. Each of the side walls is erectly arranged on the base along a longitudinal direction. Each of the side walls facing to each other and a guiding slot formed on the inner side. The two guiding slots and the base corporately define a receiving space for receiving the fan. The elastic clamping unit is arranged on at least one of the inner side of the side walls. The elastic clamping unit is disposed in the guiding slot. The elastic clamping unit has a top-blocking portion formed on one end thereof away from the base. The top-blocking portion has at least one part protruded from one end of the side walls away from the base, and the at least one part of the top-blocking portion shields a part of the receiving space. The fan is selectively mounted in the receiving space along the longitudinal direction. As the fan is disposing into the receiving space, the top-blocking portion is propped up by the fan, so that the elastic clamping unit is elastically curved outward. After the fan is disposed in the receiving space, at least one part of the fan is arranged in the two guiding slots. Therefore, the two guiding slots restrain the fan from moving in an axial direction, and the axial direction is parallel to a ventilation direction of the fan. The top-blocking portions and the base corporately clamp the fan, so as to restrict the fan to move along the longitudinal direction.

In order to achieve the above objectives, the present disclosure further provides an electronic device, which includes a housing and a fan. The housing includes a fan-retaining structure for receiving the fan. The fan-retaining structure includes a base, two side walls and at least one elastic clamping unit. The two side walls are disposed on the base and being opposite to each other. Each of the side walls is erectly arranged on the base along a longitudinal direction. Each of the side walls facing to each other and a guiding slot formed on the inner side. The two guiding slots and the base corporately define a receiving space for receiving the fan. The elastic clamping unit is arranged on at least one of the inner side of the side walls. The elastic clamping unit is disposed in the guiding slot. The elastic clamping unit has a top-blocking portion formed on one end thereof away from the base. The top-blocking portion has at least one part protruded from one end of the side walls away from the base, and the at least one part of the top-blocking portion shields a part of the receiving space. The fan is selectively mounted in the receiving space along the longitudinal direction. As the fan is disposing into the receiving space, the top-blocking portion is propped up by the fan, so that the elastic clamping unit is elastically curved outward. After the fan is disposed in the receiving space, at least one part of the fan is arranged in the two guiding slots. Therefore, the two guiding slots restrain the fan from moving in an axial direction, and the axial direction is parallel to a ventilation direction of the fan. The top-blocking portions and the base corporately clamp the fan, so as to restrict the fan to move along the longitudinal direction.

Thus, the present disclosure has advantages as follows. By the two guiding slots and the elastic clamping unit, the fan can be quickly installed in the receiving space, and is firmly clamped. Similarly, by the two guiding slots and the elastic clamping unit, the fan can be quickly removed out of the receiving space.

For further understanding of the present disclosure, reference is made to the following detailed description illustrating the embodiments and examples of the present disclosure. The description is for illustrative purpose only and is not intended to limit the scope of the claims.

DETAILED DESCRIPTION OF THE PREFERRED EMBODIMENTS

Figure 1:
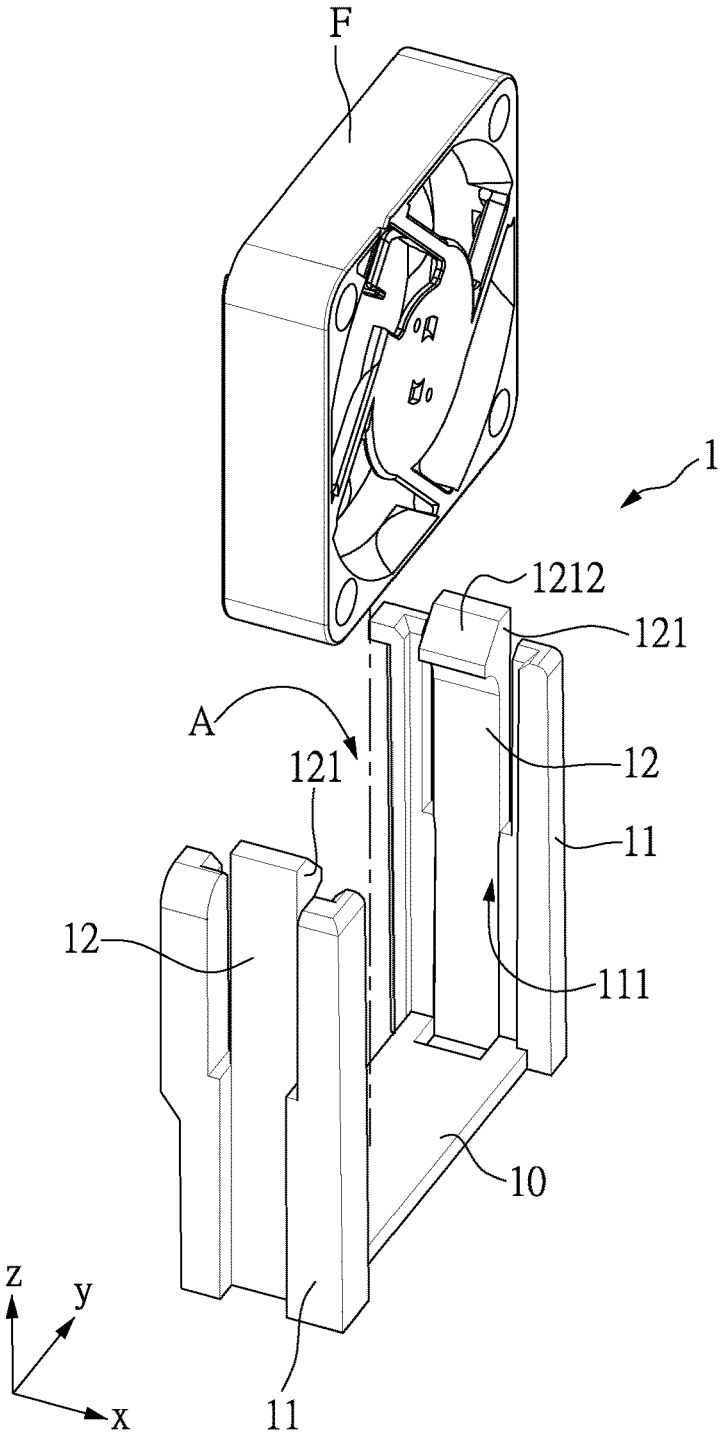
FIG. 1 is an exploded perspective view of a fan-retaining structure and a fan of the present disclosure.

The present invention is described in the following with specific embodiments, so that one skilled in the pertinent art can easily understand other advantages and effects of the present invention from the disclosure of the invention. The present invention may also be implemented and applied according to other embodiments, and the details may be modified based on different views and applications without departing from the spirit of the invention. In addition, the drawing and the components shown herein are not to scale and are made in simplicity with provision of only associated components related to the invention; in practical usage, the component may be more complexly structured and the number, size, shape and arrangement of each component can be varied accordingly.

First Embodiment

Figure 2:
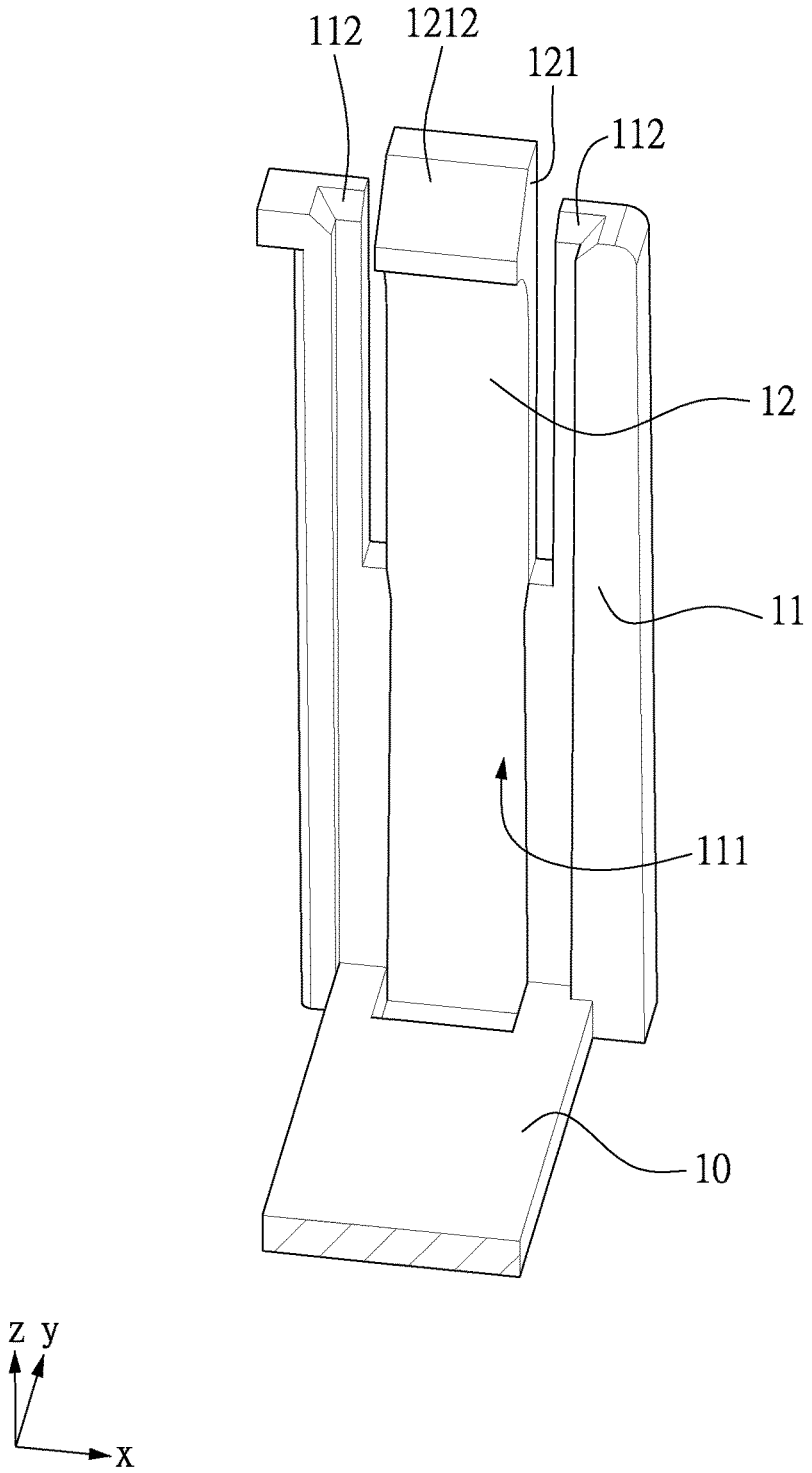
FIG. 2 is a partial cross-sectional view of the fan-retaining structure of the present disclosure.
Figure 3:
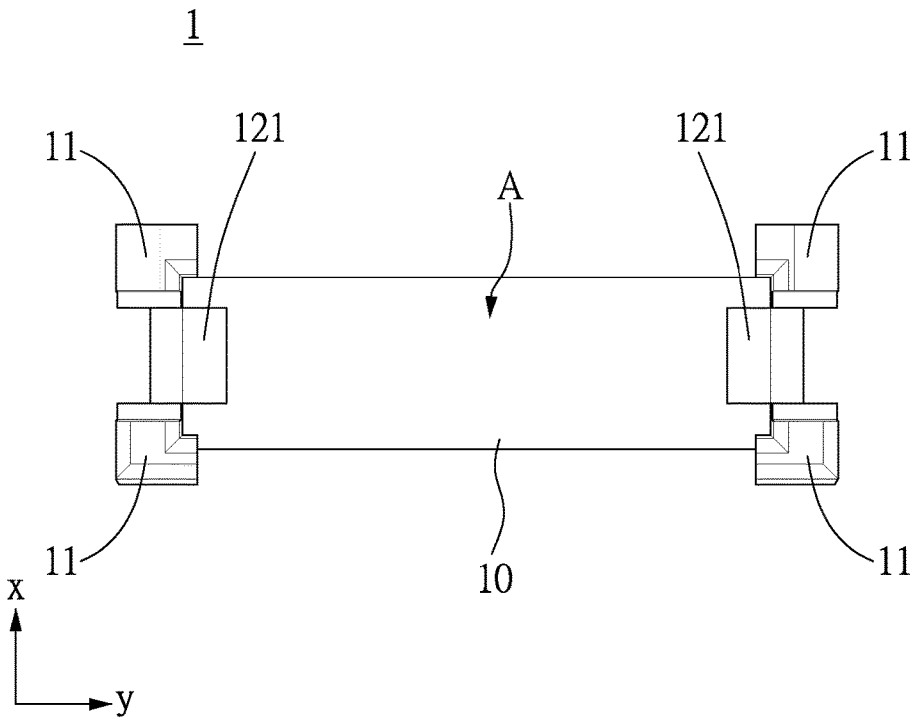
FIG. 3 is a top view of the fan-retaining structure of the present disclosure.

Refer to FIG. 1 to FIG. 6, which are different views of a fan-retaining structure of a first embodiment. As shown in FIG. 1 to FIG. 3, a fan-retaining structure 1 includes a base 10, two side walls 11 and two elastic clamping units 12. The two side walls 11 are arranged on the base 10 opposite to each other. Each side wall 11 is erectly formed on the base 10 along a longitudinal direction (that is the Z-axis direction of the coordinate system in FIG. 1). The two side walls 11 respectively have an inner side which is facing to each other and formed with a guiding slot 111. The two guiding slots 111 and the base 10 corporately define a receiving space A, so that the fan F can be received in the receiving space A along the longitudinal direction. Preferably, the two side walls 11 and the base 10 are integrally formed as one piece.

Figure 4:
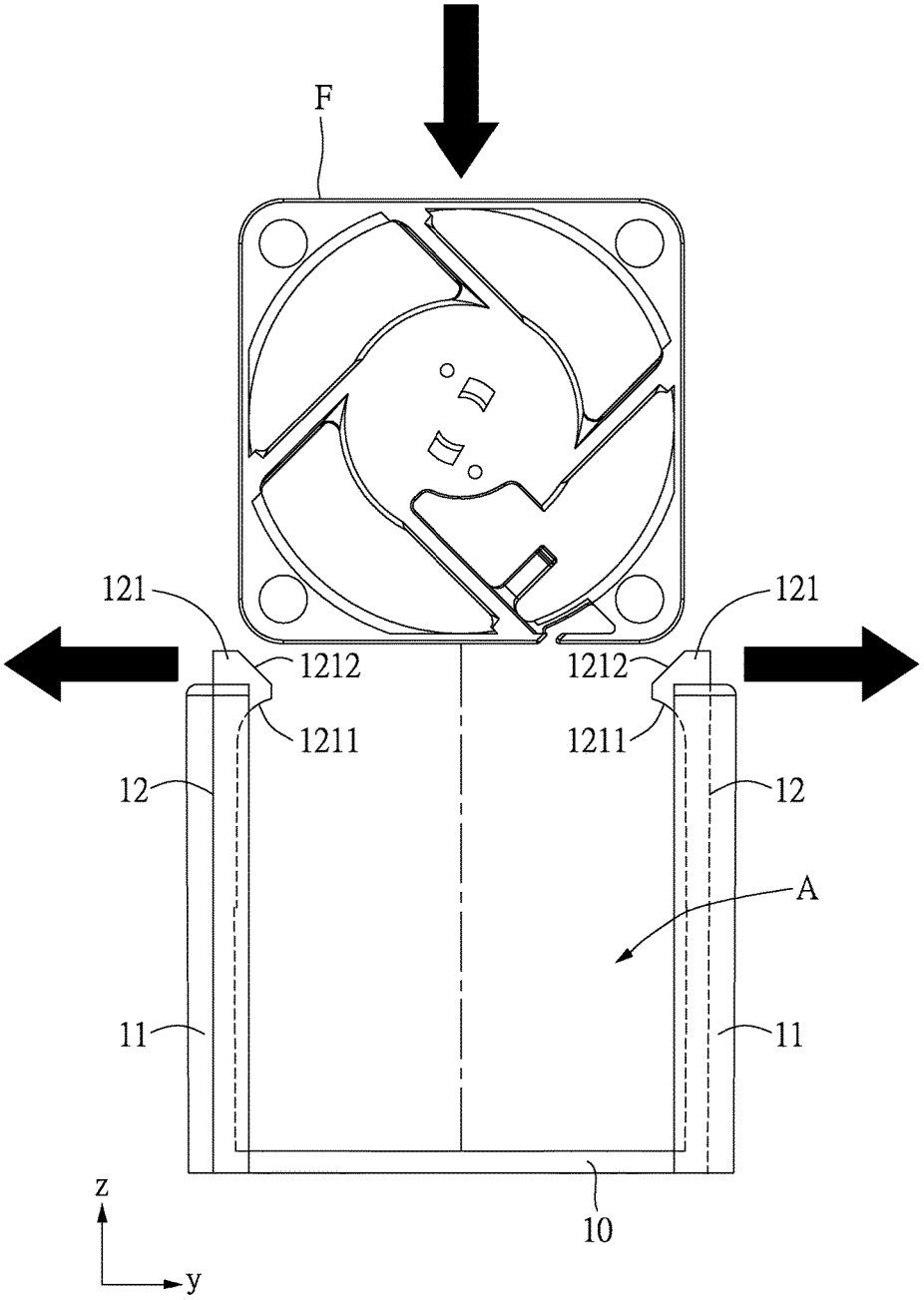
FIG. 4 is a front view of the fan assembled to the fan-retaining structure of the present disclosure.
Figure 5:
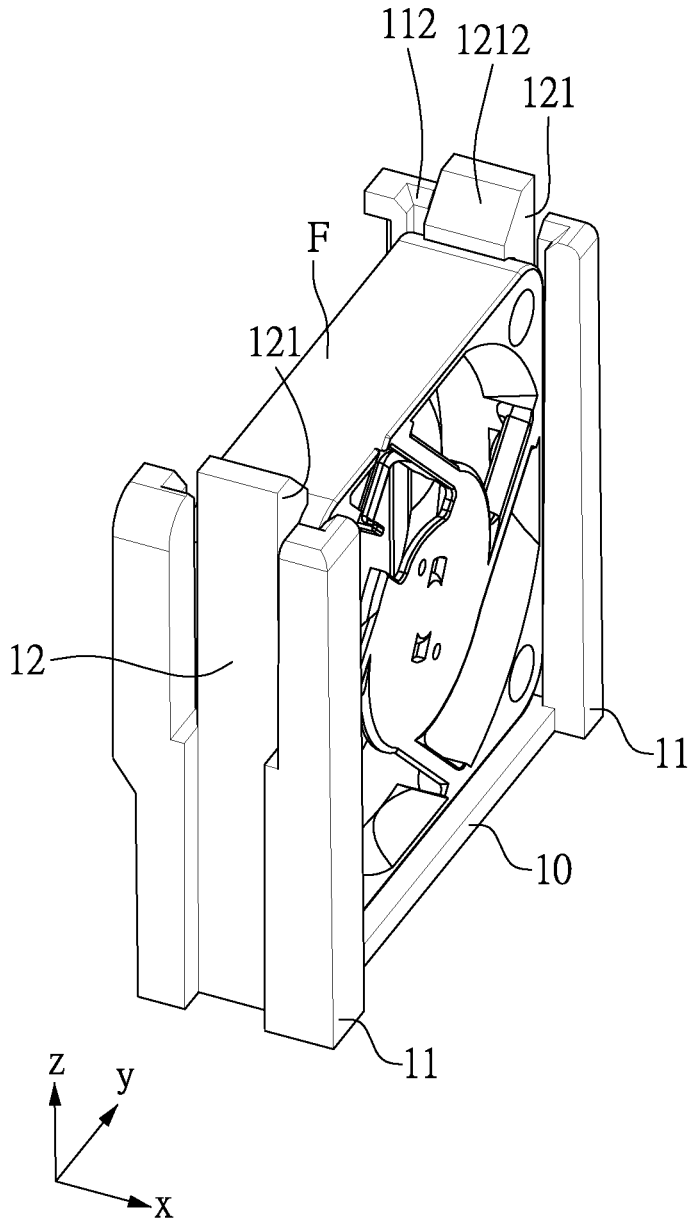
FIG. 5 is an assembled perspective view of the fan mounted in the fan-retaining structure of the present disclosure.

The two elastic clamping units 12 are formed on the inner side of the side walls 11 facing to each other. Each of the elastic clamping units 12 is arranged in the guiding slot 111, respectively. Each elastic clamping unit 12 has one end away from the base 10, which is formed with a top-blocking portion 121. Each top-blocking portion 121 has at least one part protruded from the corresponding end of the side wall 11 away from the base 10. The at least one part of the top-blocking portion 121 shields a part of the receiving space A. For more detail, according to the coordinate system as shown in FIG. 3 to FIG. 5, the top-blocking portion 121 of the elastic clamping unit 12 is protruded into the receiving space A along the Y-axis direction to form the at least one part. Each top-blocking portion 121 has a height in the Z-axis higher than the height of the side walls 11 in the Z-axis. The protruded parts of the two top-blocking portions 121 in the Y-axis partially shield a part of the receiving space A. Preferably, the base 10, the two side walls 11 and the two elastic clamping units 12 are formed integrally in one piece.

Refer to FIG. 4. Each top-blocking portion 121 of the elastic clamping unit 12 has a first guiding structure 1211 facing the base 10. Each top-blocking portion 121 has a second guiding structure 1212 formed on one side thereof opposite to the first guiding structure 1211. For more detail, each first guiding structure 1211 can be an arc-shaped structure concavely formed on an inner side of the top-blocking portion 121 facing the base 10, and extended away from the base 10. Each second guiding structure 1212 can be an inclined-plane structure inclined from an outer side toward the inner side of the top-blocking portion 121. In other embodiments, otherwise the first guiding structure 1211 can be an inclined-plane structure, for example, an inclined-plane structure symmetric with respect to the second guiding structure 1212.

Because the two top-blocking portions 121 partially shield the receiving space A, two corners of the fan F firstly abut against the second guiding structure 1212 of the top-blocking portion 121, when the fan F enters the receiving space A in the longitudinal direction. When the fan F props the two top-blocking portions 121, the two top-blocking portions 121 are curved elastically and away from each other, which is curved toward the outer side of the side wall 11. When the fan F props the two top-blocking portion 121 and the elastic clamping unit 12 curves outward, the fan F is guided by the two guiding slots 111 and disposed quickly and accurately in the receiving space A. Refer to FIG. 2. It is particularly noteworthy that, each side wall 11 is formed with a guiding bevel 112 on a top end thereof away from the base 10. The guiding bevel 112 can be an inclined plane inclined from an outer side toward an inner side of the side walls 11, which can guide the fan F to enter the guiding slot 111. When the fan F is installed in the receiving space A, the two elastic clamping units 12 clamp the fan F stably by elastic-restoring force.

Refer to FIG. 5. When the fan F is steadily disposed in the receiving space (not labelled), the top-blocking portion 121 of the two elastic clamping units 12 and the base 10 corporately clamp the fan F, so as to restrict the fan F to move in the longitudinal direction (that is the Z-axis direction of the coordinate system in figures). As shown in FIG. 1, the two guiding slots 111 of the fan-retaining structure 1 restrain the fan F from moving in an axial direction (that is about the X-axis of the coordinate system in the figures). In other words, when the fan F is installed in the receiving space A, the fan F is clamped and restricted by the two elastic clamping units 12 and restrained by the two guiding slots 111, so that the fan F is firmly and limitedly disposed in the receiving space A. The aforesaid axial direction is parallel to a ventilation direction of the fan F.

Figure 6:
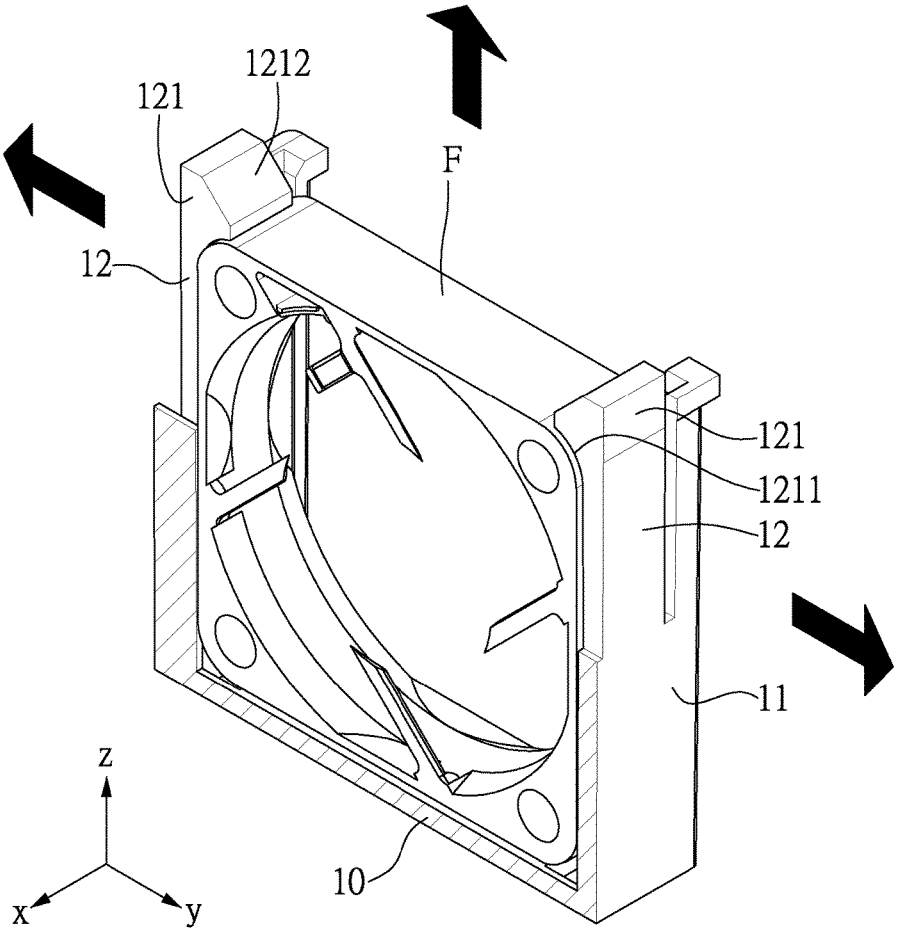
FIG. 6 is a partial cross-sectional view of the fan and the fan-retaining structure of the present disclosure.

Please refer to FIG. 3 and FIG. 6. If a user wants to take the fan F out of the fan-retaining structure 1, the user can grip and withdraw the fan F in a direction away from the base 10 (that is the Z-axis of the coordinate system in the figures, i.e. the longitudinal direction). In the meantime, the fan F is departed from the two corners of the base 10, and abuts against the first guiding structures 1211 of the two top-blocking portions 121. When the two top-blocking portions 121 are abutted, the two elastic clamping units 12 are curved elastically and away from each other. In other words, each elastic clamping unit 12 is curved outward. Therefore, the two top-blocking portions 121 and the base 10 will not restrict corporately the fan F from moving along the longitudinal direction (that is the Z-axis of the coordinate system in the figures), and the fan F can be removed out of the receiving space A.

More specifically, when two corners of the fan F prop up the two first guiding structures 1211, the reaction force exerted by the fan F will be partially transformed as a lateral reaction force (that is the Y-axis direction of the coordinate system in the figures) by each first guiding structure 1211.

The two elastic clamping units 12 therefore are affected by the lateral reaction force, and are curved elastically toward an outer side of the side walls 11. That is, when the user removes the fan F in the longitudinal direction, each elastic clamping unit 12 can be curved outward elastically by the first guiding structure 1211. In other words, the fan-retaining structure 1 allows a user to remove the fan F directly in a single-handed manner by the first guiding structures 1211 of the top-blocking portions 121.

Second Embodiment

Figure 7:
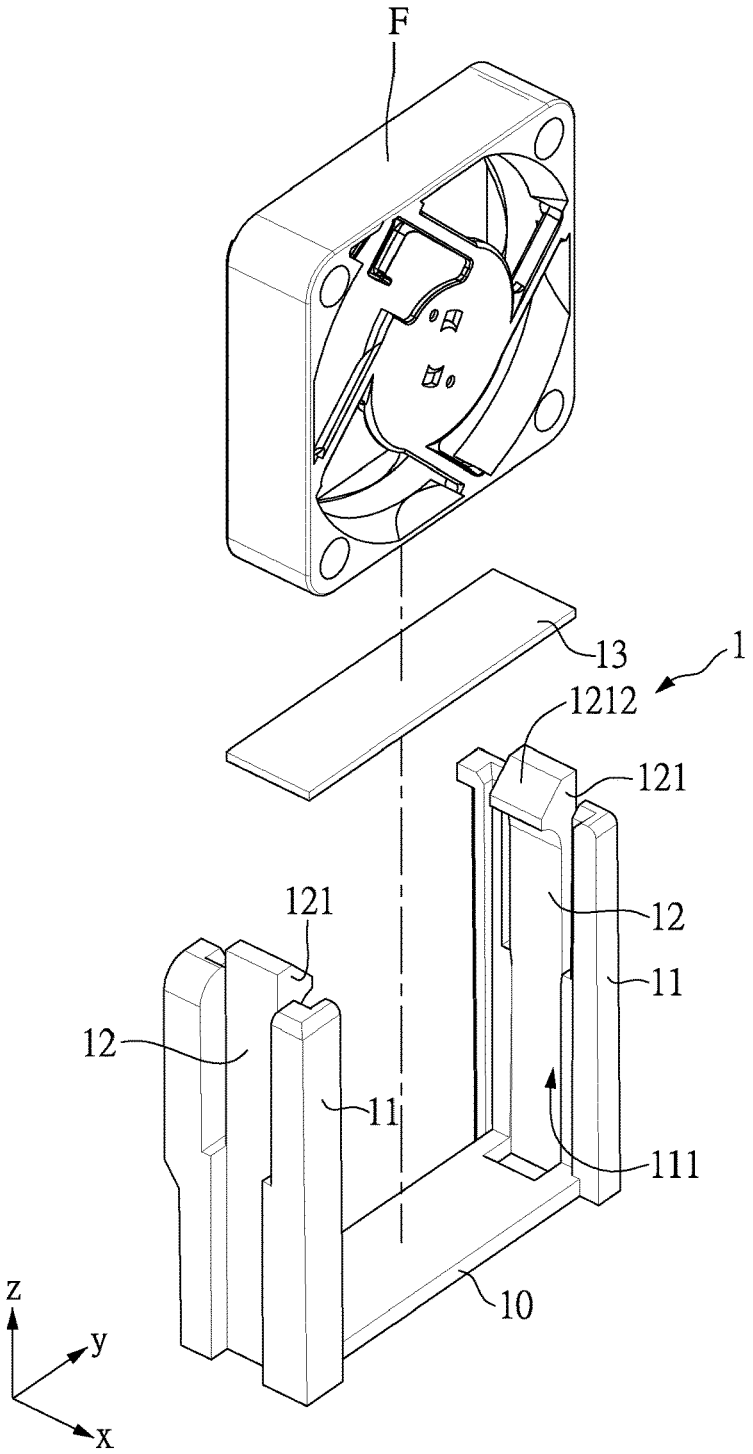
FIG. 7 is an exploded perspective view of a fan-retaining structure and a fan of a second embodiment of the present disclosure.

Please refer to FIG. 7, which is an exploded perspective view of a fan-retaining structure and fan of a second embodiment of the present disclosure. The difference between the embodiment and the above embodiment is that, the fan-retaining structure 1 further includes a buffering unit 13, which is correspondingly arranged on the base 10, and disposed in the receiving space A. The buffering unit 13 is made of shock-absorbing material, such as foamed material or elastic plastic . . . etc. In this embodiment, the buffering unit 13 is board-shaped and fully covers the base 10 correspondingly. However, the size and shape of the buffering unit 13 can be changed according to demand. When the fan F is disposing in the receiving space A, the buffering unit 13 is arranged between the fan F and the base 10, and contacts the base 10 and a surface of the fan F facing the base 10 simultaneously. When the fan F is operated, the buffering unit 13 can absorb some shock from the fan F, so as to reduce the noise produced by shock during the operation of the fan F. The damage rate of the bearing of the fan F suffered from shock can be reduced, so as to prolong the life of the fan F.

It is particularly noteworthy that, in practical usage, the numbers and position of the buffering unit 13 can be increased or decreased according to demand. For example, the fan-retaining structure 1 has two buffering units 13, which are arranged on the inner side of the two side walls 11 facing to each other. When the fan F is installed in the fan-retaining structure 1, between the fan F and the two side walls 11, there is one buffering unit 13, respectively. Otherwise, the fan-retaining structure 1 has three buffering units 13, which are disposed on the base 10 and two side walls 11.

Third Embodiment

Figure 8:
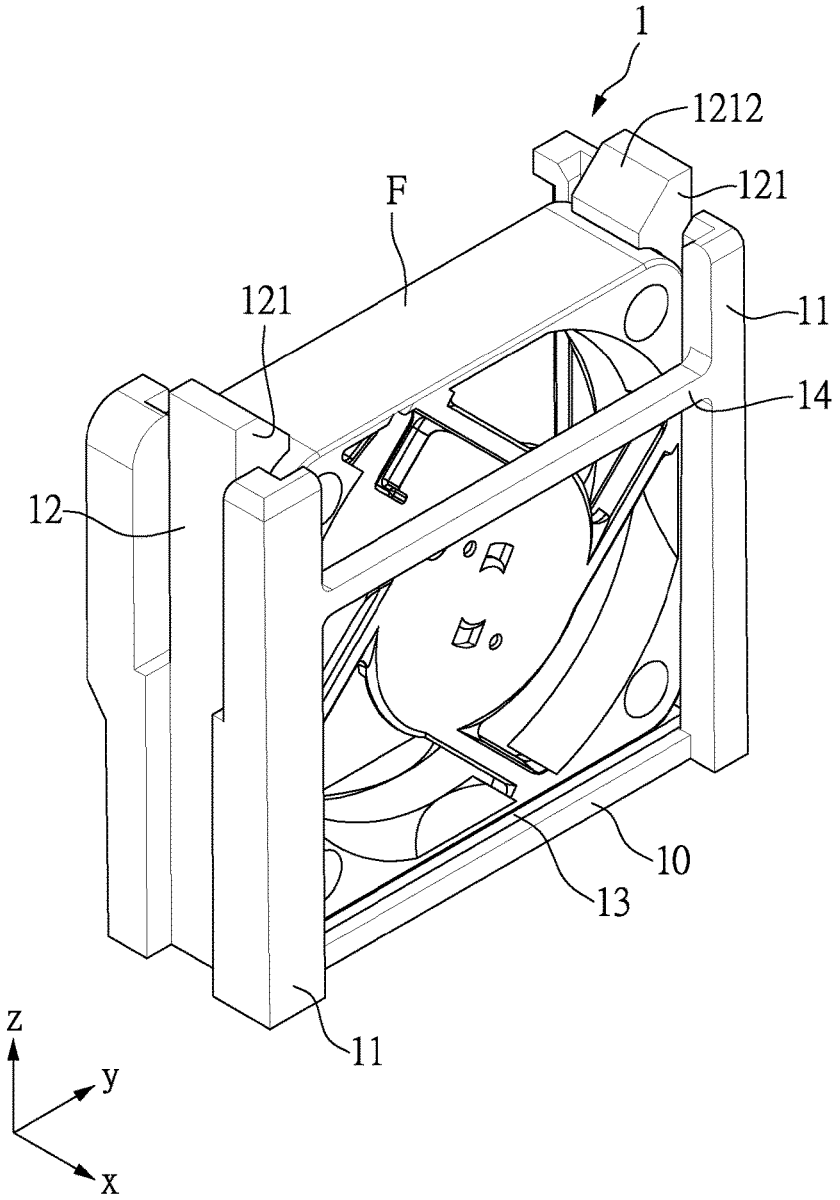
FIG. 8 is a perspective view of a fan-retaining structure and a fan of a third embodiment of the present disclosure.

Please refer to FIG. 8, which is a perspective view of a fan-retaining structure and a fan of a third embodiment of the present disclosure. As illustrated, the difference between this embodiment and the above embodiments is that, the fan-retaining structure 1 further has a structure-strengthening piece 14 with two ends connected to the two side walls 11. The entire structural strength of the fan-retaining structure 1 is increased, and the life of the fan-retaining structure 1 is prolonged. The number and position of the structure-strengthening piece 14 can be increased or decreased according to demand, is not limited by the figure. Preferably, the structure-strengthening piece 14, the two side walls 11 and the base 10 are integrally formed in one piece. It is worth noting that the structure-strengthening piece 14 not only increases the entire structural strength of the fan-retaining structure 1, but also helps to absorb some noise of shock as the fan F is operated.

Figure 9:
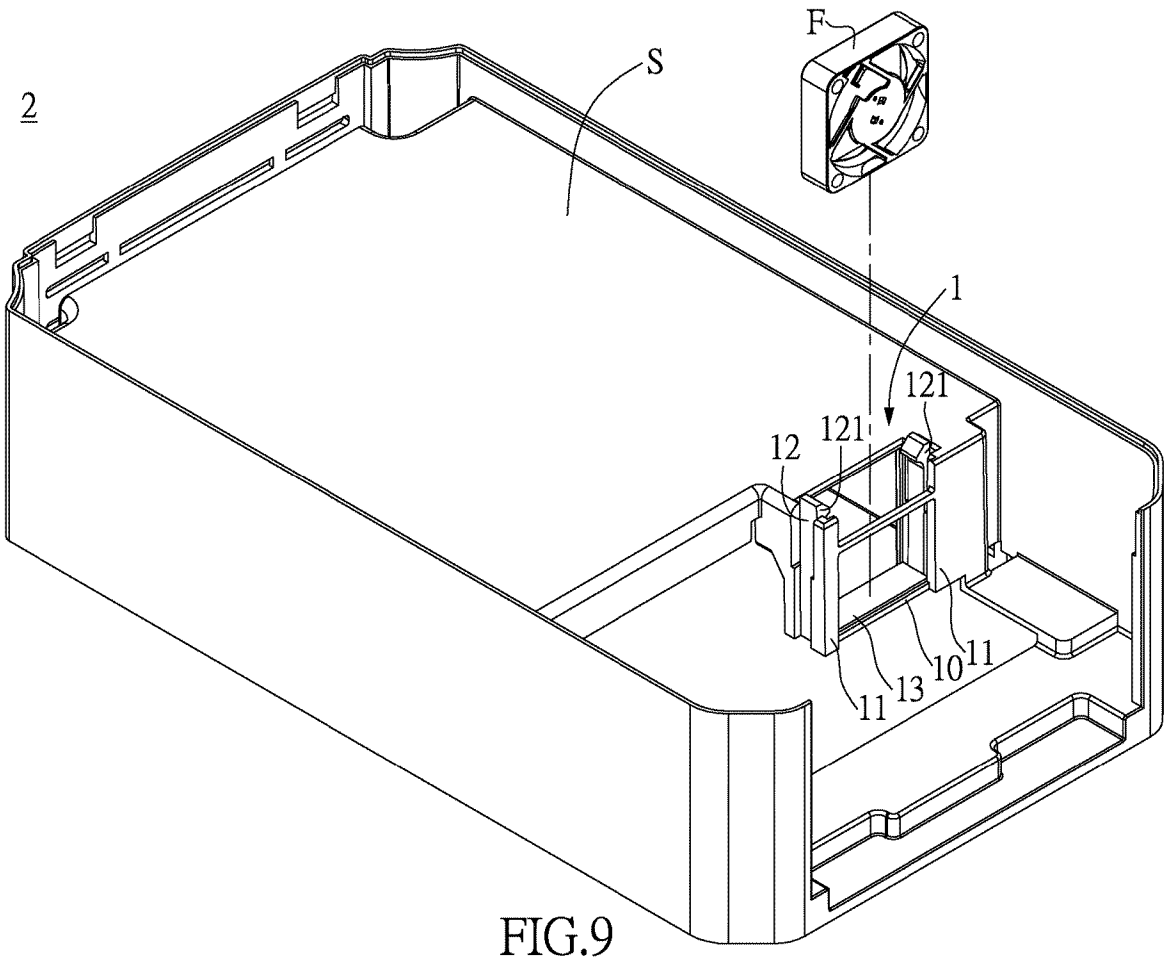
FIG. 9 is a perspective view of a housing of an electronic device and a fan of the present disclosure.

Please refer to FIG. 9, which is a perspective view of a housing of an electronic device having a fan-retaining structure for receiving a fan according to the present disclosure. The electronic device 2 includes a housing S and a fan F. The housing S includes a fan-retaining structure 1. The housing S can be installed in an electronic product casing (not shown). The fan F is installed in the fan-retaining structure 1, which can be used to dissipate heat from the electronic product casing. In this embodiment, the fan-retaining structure 1 is the same as the above embodiments without redundant description. It is particularly noteworthy that, each top-blocking portion 121 of the fan-retaining structure 1 could include a first guiding structure (not labelled, which can refer to elements 1211 in FIG. 4), which is mated with the round corners of the fan F. When the fan F is installed in the receiving space A, each first guiding structure (not labelled, refer to elements 1211 in FIG. 4) can be correspondingly adapted with or close to the round corners of the fan F.

Fourth Embodiment

Figure 10:
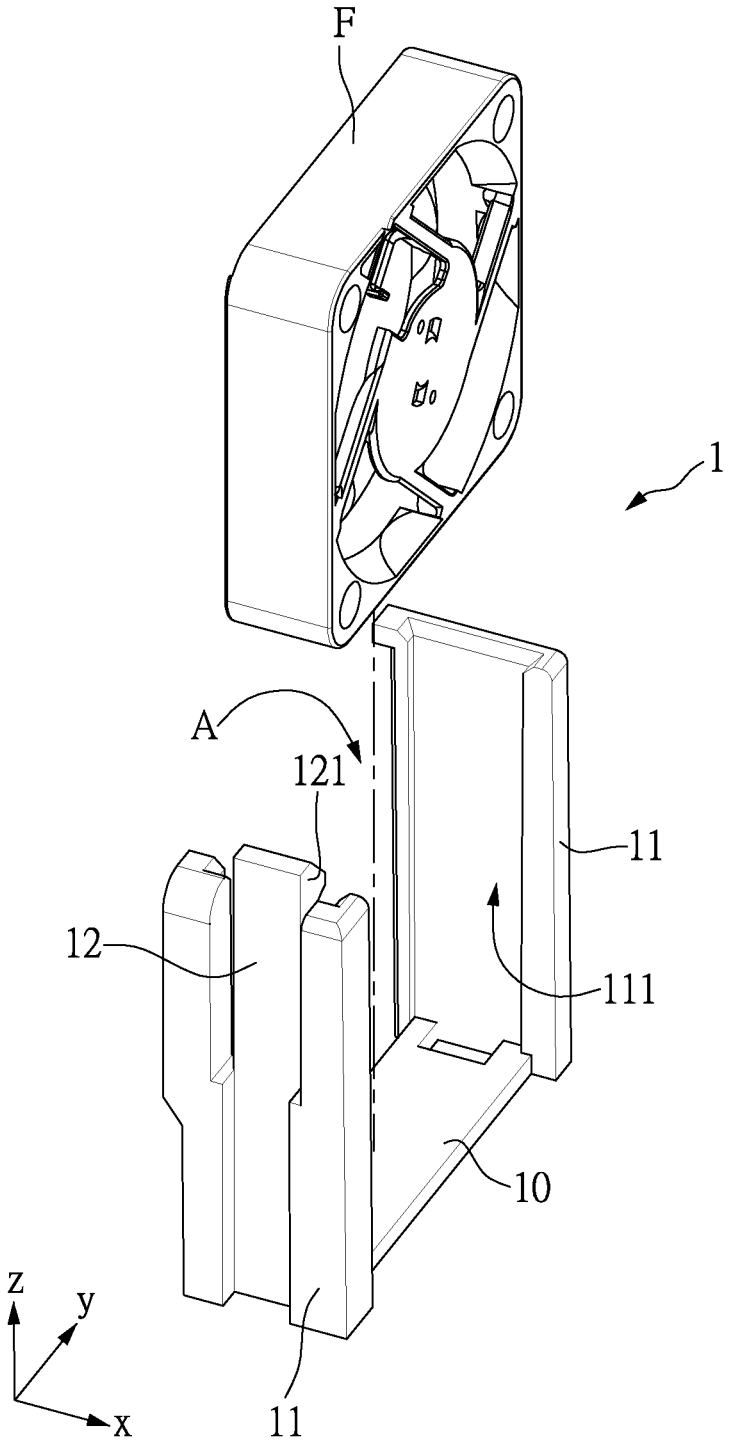
FIG. 10 is a perspective view of a fan-retaining structure of a fourth embodiment of the present disclosure.

Please refer to FIG. 10, which is a perspective view of a fan-retaining structure of a fourth embodiment of the present disclosure. The main difference of this embodiment and the above embodiments is that, the fan-retaining structure 1 has a single elastic clamping unit 12 for saving cost with regard to the above conditions. Two side walls 11 of the fan-retaining structure 1 have a guiding slot 111, respectively. One of the side walls 11 is formed with the elastic clamping unit 12, and the elastic clamping unit 12 is disposed in the guiding slot 111. The other one of the side walls 11 has only a guiding slot 111 without an elastic clamping unit 12. Similar to the above embodiments, when the fan F is installed in the receiving space A, the top-blocking portion 121 and the base 10 of the elastic clamping unit 12 corporately restrict the fan F to move in the longitudinal direction (that is the Z-axis direction of the coordinate system in the figure). The two guiding slots 111 can restrain the fan F from moving in the axial direction (that is the X-axis direction of the coordinate system in the figure). In other words, in practical usages according to practical demand, the fan-retaining structure 1 could be formed with a single elastic clamping unit 12 or two elastic clamping units 12.

Fifth Embodiment

Figure 11:
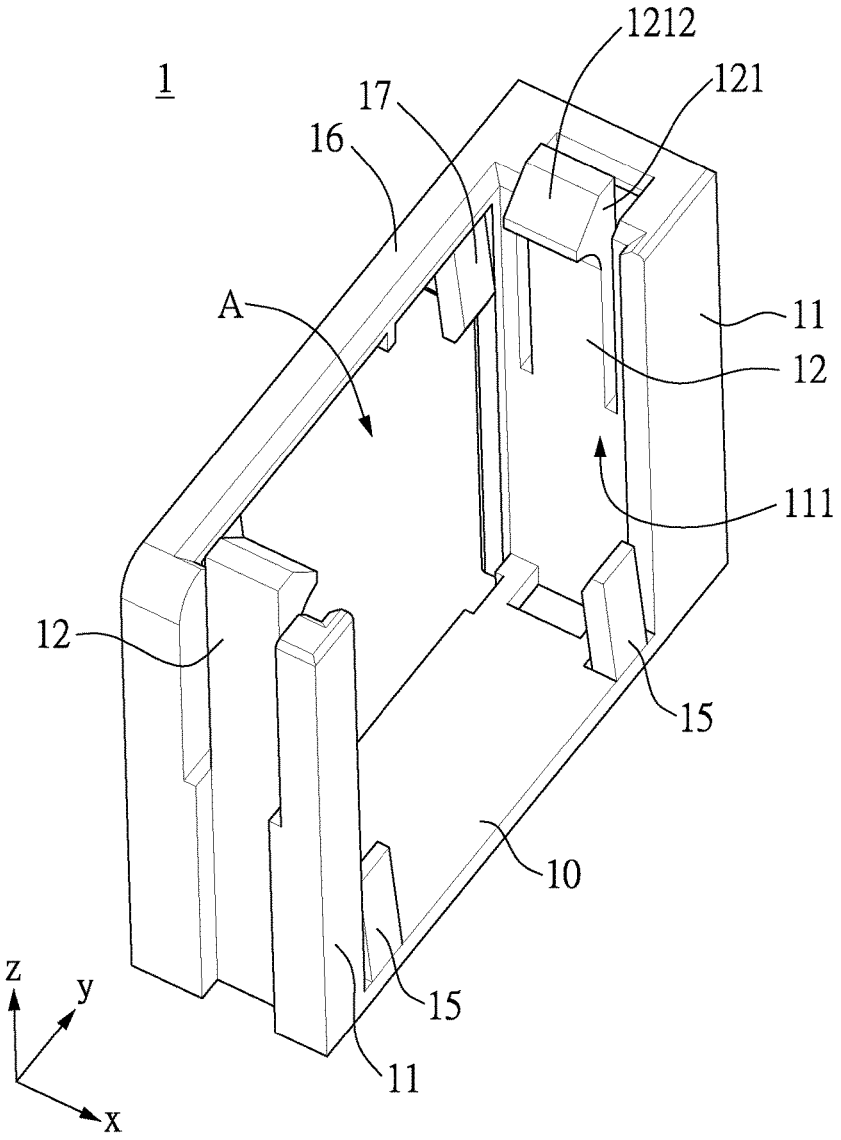
FIG. 11 is a perspective view of a fan-retaining structure of a fifth embodiment of the present disclosure.
Figure 12:
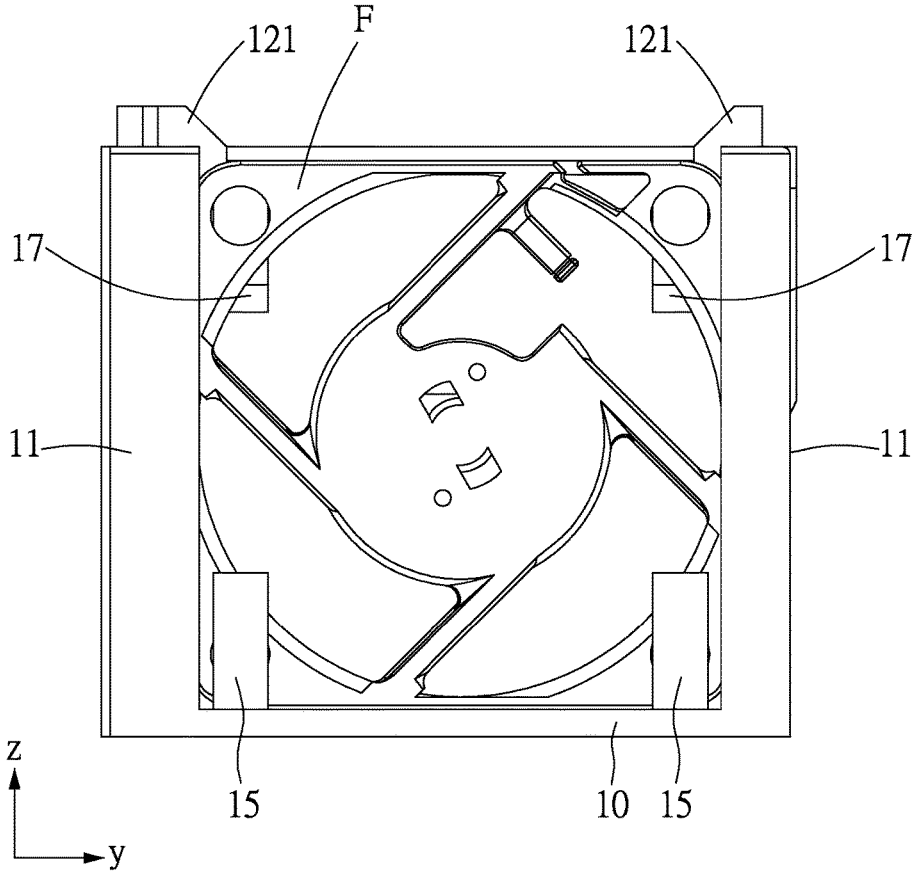
FIG. 12 is a front view of a fan-retaining structure of a fifth embodiment mounted with a fan of the present disclosure.
Figure 13:
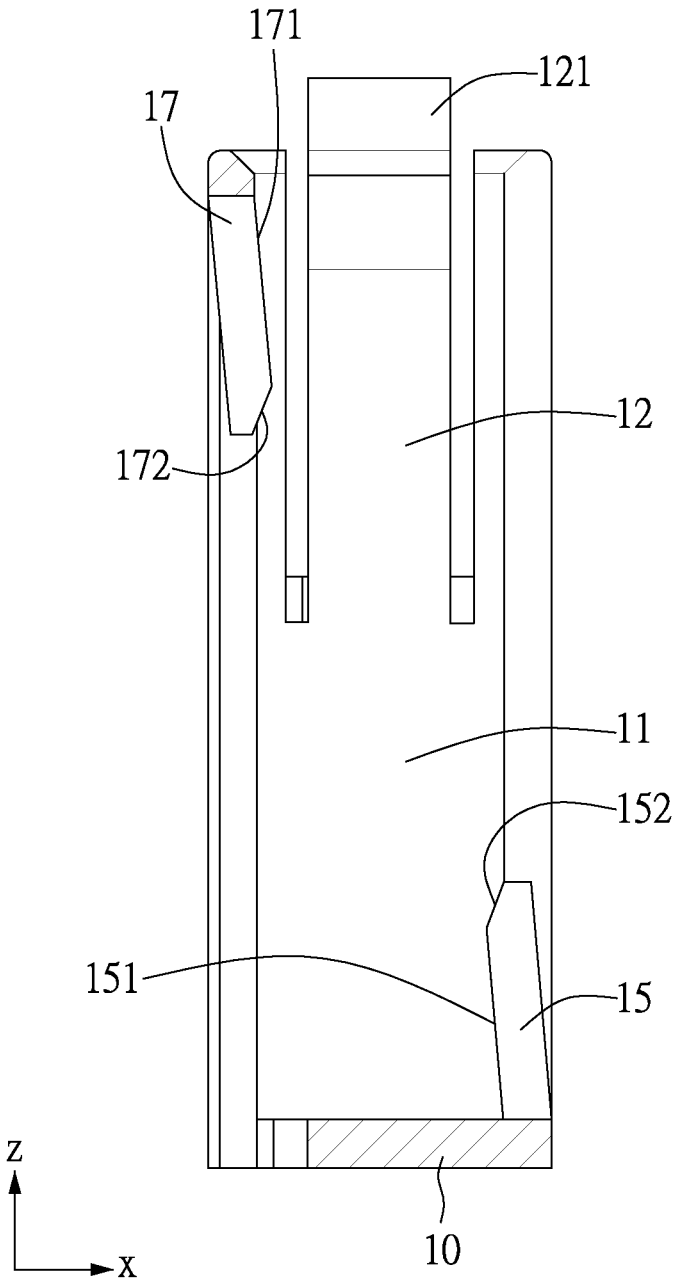
FIG. 13 is a cross-sectional side view of a fan-retaining structure of a fifth embodiment of the present disclosure.

Please refer to FIG. 11 to FIG. 13, which are different views of a fan-retaining structure of a fifth embodiment of the present disclosure. As shown in the figures, different from the above embodiments, the fan-retaining structure 1 further includes two first auxiliary elastic clampers 15, a supporter 16 and two second auxiliary elastic clampers 17. The first auxiliary elastic clamper 15 is erectly (which is substantially along the longitudinal direction and the Z-axis direction) disposed on the base 10, and in the receiving space A. The two ends of the supporter 16 are connected to one end of two side walls 11 away from the base 10. The two second auxiliary elastic clamper 17 erectly (which is substantially along the longitudinal direction and the Z-axis direction) disposed on the supporter 16 and in the receiving space A. Preferably, each first auxiliary elastic clamper 15 and each second auxiliary elastic clamper 17, the base 10 and the side walls 11 can be integrally formed in one piece.

Therefore, as the fan F is installing in the receiving space A, not only can two elastic clamping units 12 clamp the fan F together, but also the first auxiliary elastic clampers 15 and the second auxiliary elastic clampers 17 can clamp the fan F simultaneously. Therefore, the fan F is more firmly installed in the fan-retaining structure 1. Further, the first auxiliary elastic clampers 15 and the second auxiliary elastic clampers 17 can help to absorb some shock as the fan F is operating. Noise due to the shock of the fan F can be reduced, so as to prolong the service life of the fan F.

For more detail, as shown in FIG. 11 and FIG. 13, two first auxiliary elastic clampers 15 and two second auxiliary elastic clampers 17 are arranged adjacent to two side walls 11. The positions of the first auxiliary elastic clampers 15 are corresponding to the positions of the second auxiliary elastic clampers 17, respectively. Otherwise, in practical usage, the arrangement and number of the first auxiliary elastic clamper 15 and the second auxiliary elastic clamper 17 can be changed according to demand, not limited by the figures. For example, the fan-retaining structure 1 has one first auxiliary elastic clamper 15 and one second auxiliary elastic clamper 17. The first auxiliary elastic clamper 15 is arranged close to one of the side walls 11, and the second auxiliary elastic clamper 17 is arranged close to the other one of the side walls 11.

In other alternative embodiments, the fan-retaining structure 1 can include many pairs of first auxiliary elastic clampers 15. For example, the fan-retaining structure 1 has two first auxiliary elastic clampers 15, which are substantially disposed on the diagonal line of the base 10. Alternatively, the fan-retaining structure 1 has four first auxiliary elastic clampers 15, which are substantially disposed at four corners of the base 10, respectively. In another embodiment, the fan-retaining structure 1 further has two supporters 16 (not shown) and many pairs of second auxiliary elastic clampers 17. The second auxiliary elastic clampers 17 could be arranged similar to the many pairs of first auxiliary elastic clampers 15. In a specific embodiment, the first auxiliary elastic clamper 15 can be arranged on two side walls 11, or on the base 10 and two side walls 11.

An additional remark, as shown in FIG. 11 and FIG. 13, preferably, each first auxiliary elastic clamper 15 and each second auxiliary elastic clamper 17 can be formed in an inclined shape and inclined toward an inner part of the fan-retaining structure 1. Each first auxiliary elastic clamper 15 has one side closed to the base 10 which is formed with a first inclined plane 151, and each second auxiliary elastic clamper 17 has one side away from the base 10 which is formed with a first inclined plane 171. Further, each first auxiliary elastic clamper 15 has one end away from the base 10 which is formed with a second inclined plane 152, and each second auxiliary elastic clamper 17 has one end away from the supporter 16 which is formed with a second inclined plane 172.

Therefore, when the fan F is installing in the receiving space A, one side of the fan F abuts against the first inclined plane 171 of the second auxiliary elastic clamper 17. Each second auxiliary elastic clamper 17 therefore is curved outward elastically; and one side of the fan F abuts against the second inclined planes 152 of the first auxiliary elastic clampers 15 and part of the first inclined plane 151. Each first auxiliary elastic clamper 15 therefore is curved outward elastically. After the fan F is installed in the receiving space A, each first auxiliary elastic clamper 15 and each second auxiliary elastic clamper 17 firmly clamp the fan F by the elastic-restoring force.

In a reverse operation order, when the fan F is taken out of the receiving space A, one side of the fan F abuts against the first inclined planes 151 of the first auxiliary elastic clampers 15. The first auxiliary elastic clampers 15 are curved outward elastically. Further, the fan F abuts against the second inclined planes 172 and some of the first inclined planes 171 of the second auxiliary elastic clampers 17, so that the second auxiliary elastic clamper 17 is curved outward elastically. The fan F therefore can be withdrawn from the receiving space A. Similar to the above embodiments, even though the fan-retaining structure 1 of this embodiment has the first auxiliary elastic clampers 15 and the second auxiliary elastic clampers 17, the user still can take the fan F out of the fan-retaining structure 1 by a one-handed manner.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A fan-retaining structure, for receiving a fan, the fan-retaining structure comprising:

a base;

two side walls, disposed on the base and being opposite to each other, each of the side walls erectly arranged on the base along a longitudinal direction, each of the side walls having an inner side facing to each other and a guiding slot formed on the inner side, wherein the two guiding slots and the base corporately define a receiving space for receiving the fan; and a pair of elastic clamping units, respectively arranged on the inner side of the two side walls, and respectively disposed in the guiding slots, wherein each of the elastic clamping units has a top-blocking portion formed on a top end thereof away from the base, wherein the top-blocking portion has at least one part protruded outside a top end of the side walls away from the base, and each of the top-blocking portions protruded into the receiving space;

wherein an inner surface of the top-blocking portion having a width substantially equal to a width of the guiding slot, so as to fully retaining the fan between the pair of clamping units;

wherein the fan is selectively mounted in the receiving space along the longitudinal direction; as the fan is disposing into the receiving space, the top-blocking portion is propped up by the fan, so that the elastic clamping units are elastically curved outward; whereby after the fan is disposed in the receiving space, two sides of the fan are respectively arranged in the two guiding slots, and a height of the guiding slot between the two side walls is substantially equal to a height of the fan; wherein the two guiding slots restrain the fan from moving in an axial direction of the fan; wherein the top-blocking portions and the base corporately clamp the fan, so as to restrain the fan from moving in the longitudinal direction.

2. The fan-retaining structure as claimed in claim 1, wherein each of the top-blocking portions has one side facing the base formed with a first guiding structure; wherein as the fan is moving from the receiving space away from the base, each of the first guiding structures is propped up by the fan and elastically curved away from each other, whereby the elastic clamping units are curved elastically away from each other.

3. The fan-retaining structure as claimed in claim 2, wherein each of the top-blocking portions has a second guiding structure formed on one side thereof opposite to the first guiding structure; whereby as the fan is disposing in the receiving space, the second guiding structures are propped up by the fan, and the pair of elastic clamping units are curved elastically away from to each other.

4. The fan-retaining structure as claimed in claim 3, wherein the first guiding structure is an arc-shaped structure concavely formed on an inner side of the top-blocking portion facing the base, the arc-shaped structure is extended away from the base.

5. The fan-retaining structure as claimed in claim 1, further comprising at least one buffering unit correspondingly arranged on the base or on the inner side of the side walls facing to each other in the receiving spaces; whereby as the fan is disposing in the receiving space, one side of the buffering unit contacts a surface of the fan.

6. The fan-retaining structure as claimed in claim 1, further comprising at least one structure-strengthening piece having two ends connected the two side walls respectively.

7. The fan-retaining structure as claimed in claim 1, wherein each of the side walls has a plurality of guiding bevels on one end thereof away from the base.

8. The fan-retaining structure as claimed in claim 1, further comprising at least one first auxiliary elastic clamper erectly disposed on the base; whereby as the fan is disposing in the receiving space, the first auxiliary elastic clamper elastically clamps the fan.

9. The fan-retaining structure as claimed in claim 8, further comprising a supporter and at least one second auxiliary elastic clamper; wherein the supporter has two ends respectively connected two ends of the two side walls away from the base; wherein the at least one second auxiliary elastic clamper is erectly disposed on the supporter and in the receiving space; whereby as the fan is disposing in the receiving space, the second auxiliary elastic clamper elastically clamps the fan.

10. The fan-retaining structure as claimed in claim 9, wherein the at least one first auxiliary elastic clamper and the at least one second auxiliary elastic clamper are formed in inclined shape;

whereby as the fan is disposing in the receiving space, the at least one first auxiliary elastic clamper and the at least one second auxiliary elastic clamper are propped up by the fan and curved outward elastically; whereby after the fan is disposed in the receiving space, the at least one first auxiliary elastic clamper and the second auxiliary elastic clamper are elastically restored to an original position to clamp sides of the fan.

11. The fan-retaining structure as claimed in claim 10, wherein the at least one first auxiliary elastic clamper close to the base formed with a first inclined plane, and the at least one second auxiliary elastic clamper has one side away from the base formed with a first inclined plane;

wherein the at least one first auxiliary elastic clamper has one end away from the base formed with a second inclined plane, and the at least one second auxiliary elastic clamper has one end away from the supporter formed with a second inclined plane;

whereby as the fan is disposing in or removed out of the receiving space, the fan abuts against the first inclined planes and the second inclined planes, so that the at least one first auxiliary elastic clamper and the at least one second auxiliary elastic clamper are curved outward elastically.

12. The fan-retaining structure as claimed in claim 9, wherein the base, the side walls, the elastic clamping units, the first auxiliary elastic clamper, the supporter and the second auxiliary elastic clamper are integrally formed in one piece.

13. An electronic device, comprising a housing and a fan, the housing having a fan-retaining structure for receiving the fan, the fan-retaining structure comprising:

a base;

two side walls, disposed on the base and being opposite to each other, each of the side walls erectly arranged on the base along a longitudinal direction, each of the side walls having an inner side facing to each other and a guiding slot formed on the inner side, wherein the two guiding slots and the base corporately define a receiving space for receiving the fan; and a pair of elastic clamping units, respectively arranged on the inner side of the two side walls and respectively disposed in the guiding slots;

wherein each of the elastic clamping unit has a top-blocking portion formed on a top end thereof away from the base, wherein the top-blocking portion has at least one part protruded outside a top end of the side walls away from the base, and each of the top-blocking portions protruded into the receiving space;

wherein an inner surface of the top-blocking portion having a width substantially equal to a width of the guiding slot, so as to fully retaining the fan between the pair of elastic clamping units;

wherein the fan is selectively mounted in the receiving space along the longitudinal direction; as the fan is disposing into the receiving space, the top-blocking portion is propped up by the fan, so that the elastic clamping units are elastically curved outward; whereby after the fan is disposed in the receiving space, two sides of the fan are respectively arranged in the two guiding slots, and a height of the guiding slot between the two side walls is substantially equal to a height of the fan;

whereby the two guiding slots restrain the fan from moving in an axial direction of the fan; whereby the top-blocking portions and the base corporately clamp the fan, so as to restrain the fan from moving in the longitudinal direction.

14. The electronic device as claimed in claim 13, wherein each of the top-blocking portions has one side facing the base formed with a first guiding structure; wherein as the fan is moving from the receiving space away from the base, each of the first guiding structures is propped up by the fan and elastically curved away from each other, whereby the elastic clamping units are curved elastically away from each other without a restriction regard with the fan in the longitudinal direction.

15. The electronic device as claimed in claim 14, wherein each of the top-blocking portions has a second guiding structure formed on one side thereof opposite to the first guiding structure; whereby as the fan is disposing in the receiving space, the second guiding structures are propped up by the fan, and the pair of elastic clamping units are curved elastically away from each other.

16. The electronic device as claimed in claim 15, wherein the first guiding structure is an arc-shaped structure concavely formed on an inner side of the top-blocking portion facing the base, the arc-shaped structure is extended away from the base.

17. The electronic device as claimed in claim 13, wherein the fan-retaining structure further includes at least one buffering unit correspondingly arranged on the base or on the inner side of the side walls facing to each other in the receiving spaces; whereby as the fan is disposing in the receiving space, one side of the buffering unit contacts a surface of the fan.

18. The electronic device as claimed in claim 13, wherein the fan-retaining structure further includes at least one structure-strengthening piece having two ends connected the two side walls respectively.

19. The electronic device as claimed in claim 13, wherein each of the side walls has a plurality of guiding bevels on one end thereof away from the base.

20. The electronic device as claimed in claim 13, wherein the fan-retaining structure further includes at least one first auxiliary elastic clamper erectly disposed on the base; whereby as the fan is disposing in the receiving space, the first auxiliary elastic clamper elastically clamps the fan.

21. The electronic device as claimed in claim 20, wherein the fan-retaining structure further includes a supporter and at least one second auxiliary elastic clamper; wherein the supporter has two ends respectively connected to two ends of the two side walls away from the base; wherein the at least one second auxiliary elastic clamper is erectly disposed on the supporter and in the receiving space; whereby as the fan is disposing in the receiving space, the second auxiliary elastic clamper elastically clamps the fan.

22. The electronic device as claimed in claim 21, wherein the at least one first auxiliary elastic clamper and the at least one second auxiliary elastic clamper are formed in inclined shape;

whereby as the fan is disposing in the receiving space, the at least one first auxiliary elastic clamper and the at least one second auxiliary elastic clamper are propped up by the fan and curved outward elastically; whereby after the fan is disposed in the receiving space, the at least one first auxiliary elastic clamper and the second auxiliary elastic clamper are elastically restored to an original position to clamp sides of the fan.

23. The electronic device as claimed in claim 22, wherein the at least one first auxiliary elastic clamper close to the base formed with a first inclined plane, and the at least one second auxiliary elastic clamper has one side away from the base formed with a first inclined plane;

wherein the at least one first auxiliary elastic clamper has one end away from the base formed with a second inclined plane, and the at least one second auxiliary elastic clamper has one end away from the supporter formed with a second inclined plane;

whereby as the fan is disposing in or removed out of the receiving space, the fan abuts against the first inclined planes and the second inclined planes, so that the at least one first auxiliary elastic clamper and the at least one second auxiliary elastic clamper are curved outward elastically.

24. The electronic device as claimed in claim 21, wherein the base, the side walls, the elastic clamping units, the first auxiliary elastic clamper, the supporter and the second auxiliary elastic clamper are integrally formed in one piece.

* * * * *